US007836580B2

(12) United States Patent
Scherrer et al.

(10) Patent No.: US 7,836,580 B2
(45) Date of Patent: Nov. 23, 2010

(54) TRANSFORMER WINDING AND PRODUCTION METHOD THEREOF

(75) Inventors: Jean-Marc Scherrer, 5A, rue du Collège, F-68400 Riedisheim (FR); Jean-Paul Scherrer, 76A, avenue de la lère D.B., F-68100 Mulhouse (FR); Jean-Claude Beisser, L'Argentière la Bessée (FR)

(73) Assignees: Jean-Marc Scherrer, Riedisheim (FR); Jean-Paul Scherrer, Mulhouse (FR)

( * ) Notice: Subject to any disclaimer, the term of this patent is extended or adjusted under 35 U.S.C. 154(b) by 838 days.

(21) Appl. No.: 10/553,658

(22) PCT Filed: May 14, 2004

(86) PCT No.: PCT/FR2004/001198

§ 371 (c)(1),
(2), (4) Date: Oct. 17, 2006

(87) PCT Pub. No.: WO2004/105063

PCT Pub. Date: Dec. 2, 2004

(65) Prior Publication Data

US 2007/0171021 A1 Jul. 26, 2007

(30) Foreign Application Priority Data

May 16, 2003 (FR) ..... 03 05917

(51) Int. Cl.
*H01F 7/06* (2006.01)

(52) U.S. Cl. ..... 29/606; 29/592.1; 29/605; 72/464; 83/169; 310/179; 310/208; 336/212; 336/234

(58) Field of Classification Search ..... 29/602.1, 29/605, 606; 72/464; 83/169; 310/179, 310/208; 336/212, 234
See application file for complete search history.

(56) References Cited

U.S. PATENT DOCUMENTS

| | | | | |
|---|---|---|---|---|
| 3,466,743 | A | 9/1969 | De Puy | |
| 3,656,378 | A | 4/1972 | Davis | |
| 5,488,761 | A * | 2/1996 | Leone | 29/2.25 |

FOREIGN PATENT DOCUMENTS

| | | |
|---|---|---|
| EP | 0 436 434 | 7/1991 |

* cited by examiner

*Primary Examiner*—Paul D Kim
(74) *Attorney, Agent, or Firm*—Young & Thompson

(57) ABSTRACT

A method for producing a winding, particularly for electrical transformer from a cylindrical tubular metal element of polygonal cross-section, includes steps of machining, in a first series of passes, a first series of cuts substantially parallel to one another through all of the sides of the tubular element with the exception of a last one of said sides, and machining, in a second series of passes, a second series of cuts in said last one of said sides in order to ensure that junctions of the first series of cuts open out in the sides adjacent to the second series of cuts, so that the first and second series of cuts are continuous with respect to one another and constitute a single groove of helicoidal shape.

5 Claims, 3 Drawing Sheets

TRANSFORMER WINDING AND PRODUCTION METHOD THEREOF

BACKGROUND OF THE INVENTION

1. Field of the Invention

The present invention relates to a winding for electrical transformer and in particular a low-voltage, high-intensity secondary winding therefor, as well as to a method for producing such a winding.

2. Description of the Related Art

The manufacture of transformers able to deliver values of high intensity is often difficult by reason of the necessity to coil, particularly at the level of the secondary winding, wires of large diameter. Furthermore, in such transformers, it is particularly difficult to arrange on these windings points, such as middle points, making it possible to establish an output in communication with a determined number of turns thus allowing variable output voltages to be drawn off. Moreover, it is known that transformers of this type, probably by reason of the difficulties mentioned hereinbefore, are of particularly high cost price.

U.S. Pat. No. 3,731,243 proposes a method of producing a winding for electrical transformer in which a cylindrical tubular element of square cross-section is taken and machined by means of a circular saw with which inclined grooves are successively made on each of the faces of this cylindrical element, which grooves join one another from one side to the other so as to form a helicoidal turn. This technique presents the drawback of being long and complex to implement insofar as parallel and inclined grooves must be made on each of the faces of the tubular element.

SUMMARY OF THE INVENTION

The present invention has for its object to overcome the various drawbacks mentioned above by presenting a winding for transformer, and in particular a low-voltage, high-intensity secondary winding, which is machined in the mass of a tubular element and which is easy to implement, and therefore of relatively moderate manufacturing cost and which, moreover, presents voltage tapping points disposed on virtually any number of turns, thus allowing the user to have available a voltage, particularly output voltage, which is totally adaptable as a function of his needs.

The present invention thus relates to a method for producing a winding, particularly for electrical transformer from a cylindrical tubular metal element of polygonal cross-section, characterized in that it comprises the steps consisting in:

- machining, in a first series of passes, a series of cuts substantially parallel to one another through all of the sides of the tubular element with the exception of a last side,
- machining, in a second series of passes, cuts in said last side in order to ensure junction of the cuts opening out in the sides adjacent the latter, so that these cuts are continuous with respect to one another and constitute a single groove of helicoidal shape.

Machining of the cuts will preferably be effected by means of a rotary machining disc.

The present invention also has for its object a winding, particularly for electrical transformer, constituted by a cylindrical tubular metal element of polygonal cross-section, hollowed so as to form a helix, characterized in that at least one of the sides of the cylindrical tubular element comprises grooves which extend along a generatrix thereof, which are open on the outside and which have a cross-section in the form of a T, each of these grooves being adapted to receive means for fastening an electrical terminal. The cross-section of the tubular element will preferably be square, rectangular or triangular in shape.

BRIEF DESCRIPTION OF THE DRAWINGS

A form of embodiment of the present invention will be described hereinafter by way of non-limiting example, with reference to the accompanying drawing, in which.

DETAILED DESCRIPTION OF THE INVENTION

Figure 1:
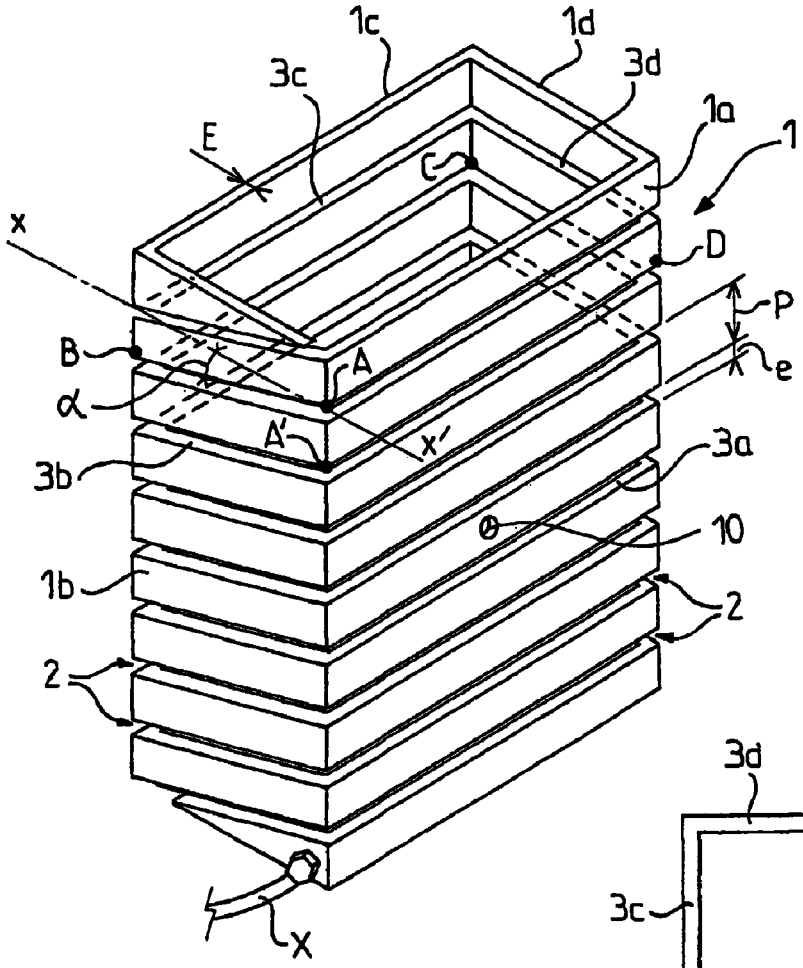
FIG. 1 is a view in perspective of a form of embodiment of a winding of a transformer according to the invention.

FIG. 1 shows in perspective a winding 1 according to the invention intended to constitute in particular the secondary winding of a transformer. This secondary winding 1 is constituted by a cylindrical tubular element of rectangular cross-section, thus comprising four principal faces 1*a*, 1*b*, 1*c*, 1*d*. This tubular element has a slot 2 made therein, of substantially helicoidal shape, which passes right through its thickness and which extends over the whole of its periphery from its apex to its base.

Figure 2:
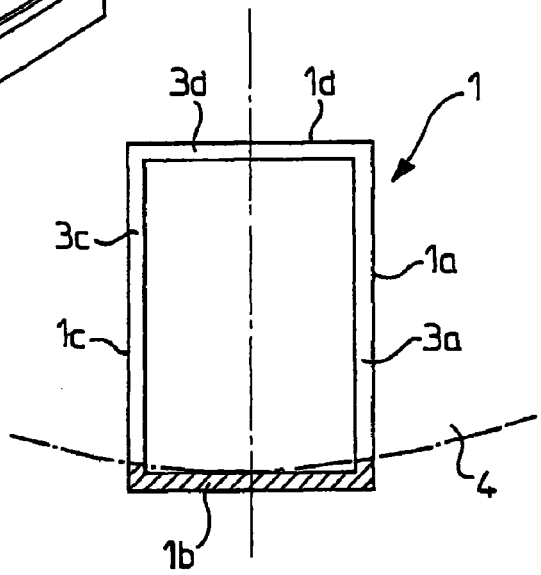
FIG. 2 is a view in vertical section of the tubular element and of the rotating tool during the first machining pass.
Figure 3:
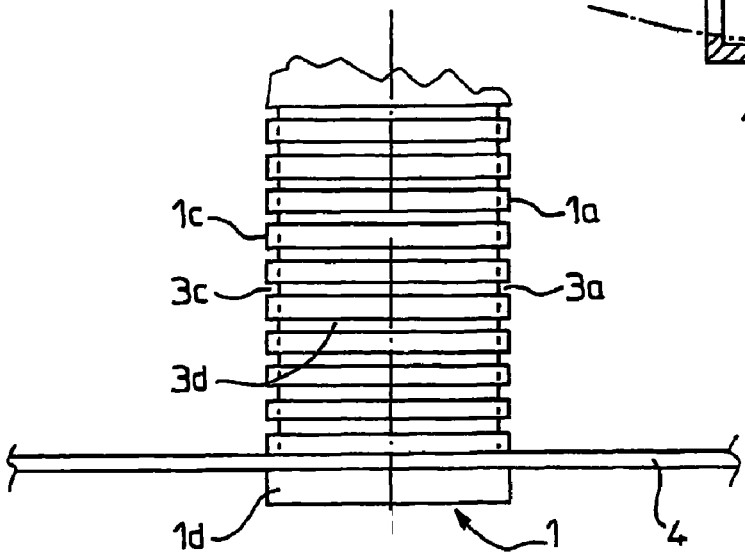
FIG. 3 is a plan view from above of the tubular element and of the machining tool shown in FIG. 2.
Figure 4:
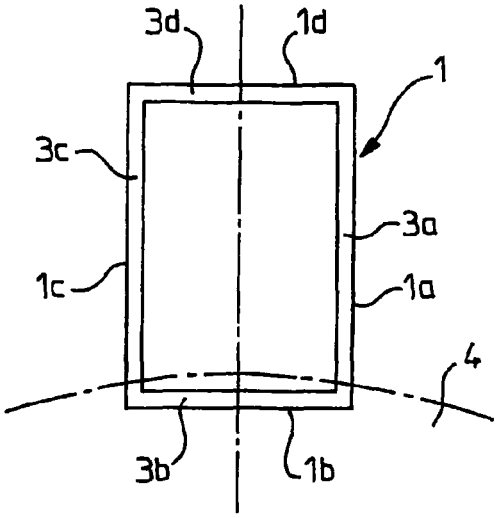
FIG. 4 is a view in vertical section of the tubular element and of the rotating tool in the course of the second machining pass.
Figure 5:
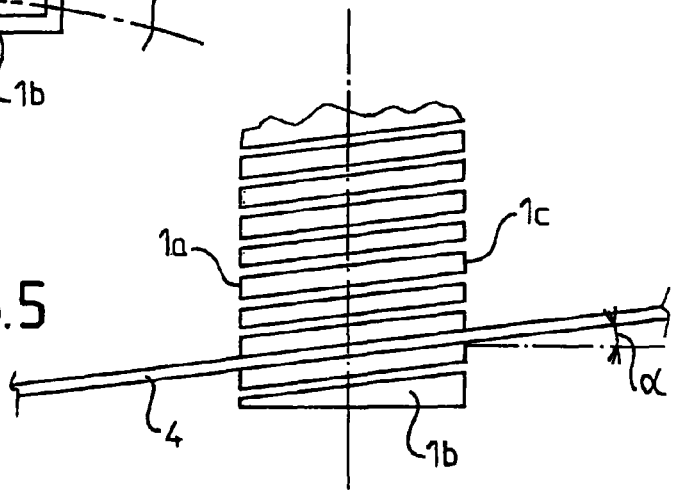
FIG. 5 is a plan view from above of the tubular element and of the machining tool shown in FIG. 4.

This slot 2 is in fact constituted by a series of rectilinear and parallel windows 3*a*, 3*b*, 3*c*, 3*d* which are machined from one of the four faces, namely here from the face 1*d*. As shown in FIGS. 1 to 5, the windows 3*a*, 3*c* and 3*d* are transversal and are machined in one single series of passes with the aid of a rotating machining disc 4 from the face 1*d* as shown in FIGS. 2 and 3, while the windows 3*b* are made during a second series of passes through the face 1*b* and are inclined by an angle a with respect to their transverse axis xx', so that they ensure the connection with the corresponding grooves 3*a* and 3*c* of the faces 1*a* and 1*c* which are adjacent thereto so as to form a substantially helicoidal slot 2, and that, when one turns around the tubular element 1, starting for example from an angle A thereof and passing through respective angles B, C and D, one arrives at point A', located beneath point A, at a distance therefrom equal to the sum of the inter-slot space, or pitch P, separating the different slots, and of the width e of the slot 2.

A helicoidal slot made in the profiled element 1 is thus definitively obtained.

This form of embodiment is particularly interesting in that it may be implemented very easily, rapidly and repetitively by numerically controlled machines which, for example, will make all the transverse parallel grooves from the face 1*d* of the tube, then, after turning of the latter and a slight inclination $\alpha$, will make the grooves 3*b* inclined by an angle $\alpha$ with respect to the transverse axis xx'.

Such a form of embodiment thus proves to be particularly easy, rapid and inexpensive to carry out in comparison, on the one hand, with the coiled embodiments of the prior state of the art requiring the use of windings constituted by wires of very large section, and, on the other hand, with the embodiment according to U.S. Pat. No. 3,731,243 which requires as many series 20 of passes as there are faces of the cylindrical tube.

In the present form of embodiment, the cross-section of the winding may be easily controlled by playing on the thickness e of the wall of the tubular element 1, and also on the value of the pitch P thereof.

The present invention is also particularly interesting in that it makes it possible to have easily available a middle point on such a winding by making, s for example as shown in FIG. 1, a simple threaded hole 10 in an inter-slot space on which it will be easy to fasten, by appropriate screwing means, an output terminal, on a conducting wire. The user may thus select, between this output terminal and a reference terminal X, virtually any secondary voltage included between 0 and the output voltage provided for the transformer.

Figure 6:
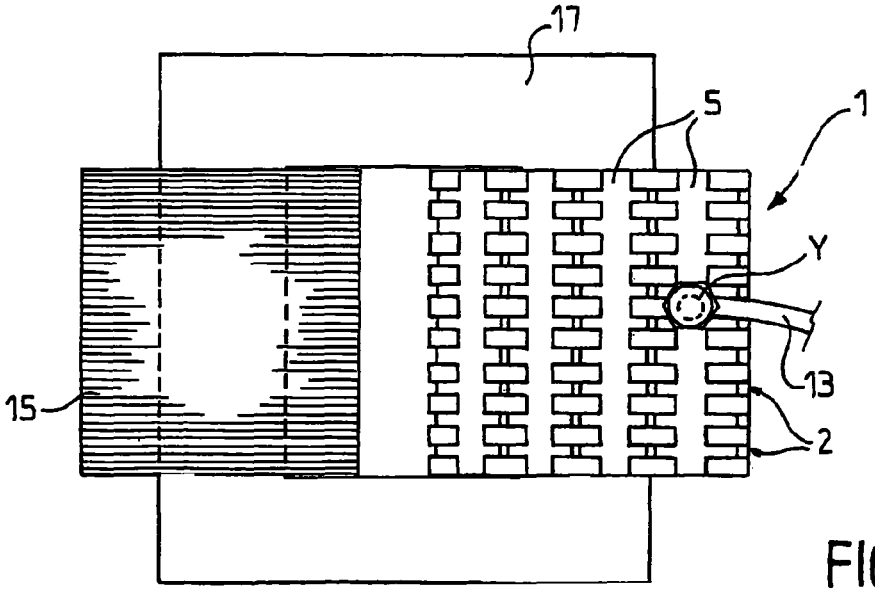
FIG. 6 is a schematic front view of an example of transformer equipped with a winding according to the invention.
Figure 7:
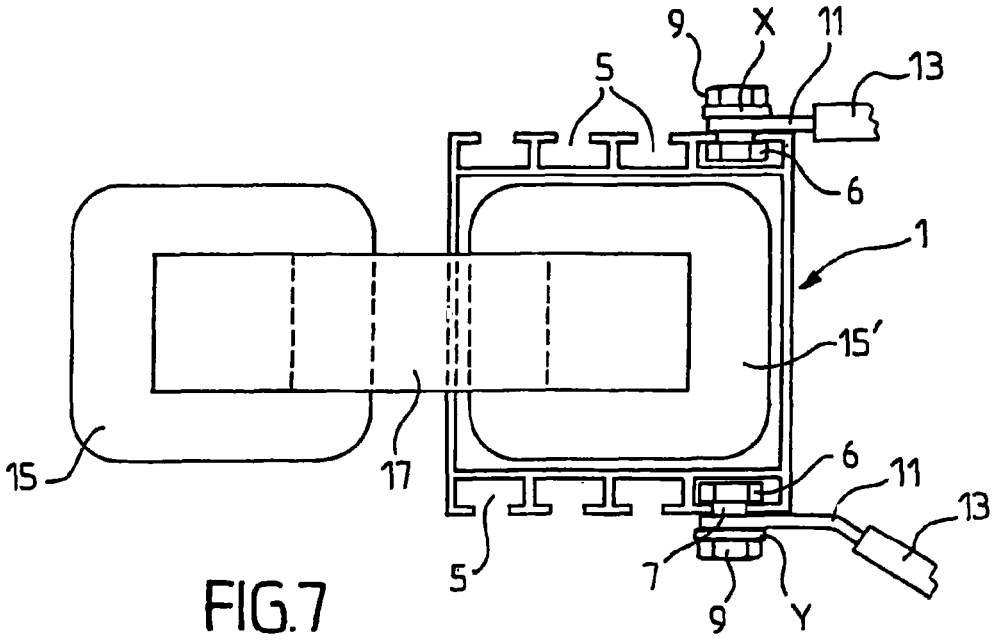
FIG. 7 is a plan view from above of the transformer shown in FIG. 6.
Figure 8:
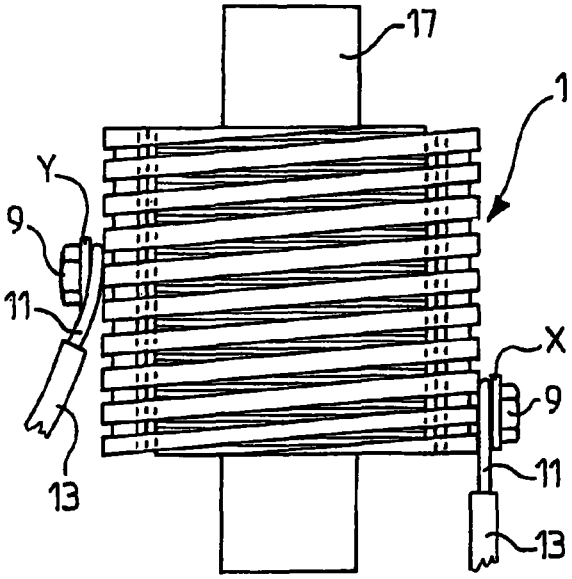
FIG. 8 is a side view of the transformer shown in FIGS. 6 and 7.

FIGS. 6 to 8 show a particularly interesting variant of the invention in which the tubular element is constituted by a profiled element whose cross-section, which clearly appears in FIG. 7, is of square shape, two opposite sides of the profiled element 1 comprising grooves 5 extending along a generatrix of the profile, which are open on the outside and have a cross-section in the form of a T. Each of these grooves 5 is thus adapted to receive the head 6 of a screw 7 making it possible, by means of a nut 9, to ensure the fastening of an electrical terminal 11 on which is welded a conducting wire 13. As shown in FIG. 7, the transformer may be constituted by a first outer primary coil 15, and by a second primary coil 15' which is disposed inside the secondary winding 1, which are connected together, in conventional manner, by a magnetic circuit 17. As in the preceding example, the secondary winding 1 of this transformer is made by machining of a type such as the one described with regard to FIG. 1. The present form of embodiment is particularly interesting in that it allows the user to have available, between a terminal X taken as reference of the secondary winding and a second terminal Y, a voltage proportional to the number of turns existing between these two terminals. In effect, the T-shaped grooves 5 make it possible to have available the means for connection of the terminal Y in virtually any zone of the two opposite faces 1*a* and 1*b*.

Figure 9:
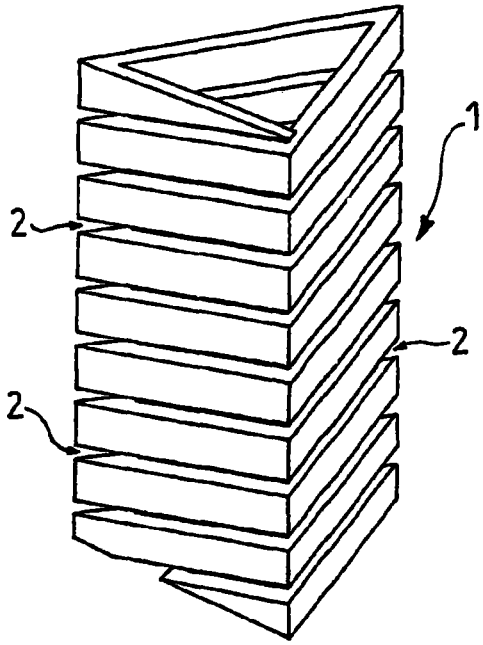
FIG. 9 is a view in perspective of a variant embodiment of the present invention.

According to the invention, the cross-section of the tubular element may, of course, be of any shape. It may thus, as shown in FIG. 9, be of triangular cross-section or of polygonal cross-section, and this as a function of the specific uses desired by the user.

For example, in the case of a tubular element of polygonal section with n sides, a first series of passes machining n-1 sides will be effected. These passes preferably being transverse with respect to the tubular element, then a second series of passes on the remaining side of which the inclination a will allow slots of the adjacent sides to be joined so as to form a helicoidal machining.

What is claimed is:

1. A method for producing a winding, particularly for an electrical transformer from a cylindrical tubular metal element of polygonal cross-section having side surfaces, characterized in that the method comprises steps of:

machining, in a first series of passes, a first series of cuts substantially parallel to one another through each of the side surfaces, except for one of the side surfaces of the tubular element with the first series of cuts, being substantially perpendicular to a longitudinal axis of the tubular element; and machining, in a second series of passes, a second series of cuts in said one of said side surfaces in order to ensure that junctions of the first series of cuts open out adjacent to the second series of cuts, so that the first and second series of cuts are continuous with respect to one another and constitute a single groove of helicoidal shape.

2. The method according to claim 1, characterized in that machining of the first and second series of cuts is ensured by means of a rotary machining disc.

3. The method according to claim 1, wherein the second series of cuts are inclined from each of the first series of cuts.

4. The method according to claim 1, wherein the first series of cuts cut along an entirety of each of the side surfaces with the exception of said one of said side surfaces.

5. The method according to claim 4, wherein the second series of cuts cut along an entirety said one of said side surfaces.

* * * * *